US005109552A

United States Patent [19]

Osmond

[11] Patent Number: 5,109,552

[45] Date of Patent: May 5, 1992

[54] PRIMER TANK TOILET FLUSHING APPARATUS

[76] Inventor: John S. Osmond, 731 Cedar St., Santa Monica, Calif. 90405

[21] Appl. No.: 585,948

[22] Filed: Sep. 21, 1990

[51] Int. Cl.[5] ..... E03D 1/10

[52] U.S. Cl. ..... 4/368; 4/375; 4/376; 4/415; 4/363

[58] Field of Search ..... 4/378, 368, 375, 372, 4/377, 396, 415, 344, 343, 422, 363, 376; 137/142, 151, 134, 135

[56] References Cited

U.S. PATENT DOCUMENTS

| | | | |
|---|---|---|---|
| 446,808 | 2/1891 | Blessing | 4/396 X |
| 456,178 | 7/1891 | Wells | 4/377 |
| 514,188 | 2/1894 | Harvey | 4/368 |
| 882,451 | 3/1908 | Brocke | 137/134 |
| 949,927 | 2/1910 | Glannon | 4/368 |
| 1,077,329 | 11/1913 | Cabral | 4/375 |
| 1,104,292 | 7/1914 | Cowperthwaite | 4/368 X |
| 1,436,350 | 11/1922 | Lundberg | 4/375 X |
| 1,461,673 | 7/1923 | Papin | 4/375 X |
| 1,540,890 | 6/1925 | Lawson | 4/377 |
| 2,152,062 | 3/1939 | Kolarik | 4/368 |

FOREIGN PATENT DOCUMENTS

| | | | |
|---|---|---|---|
| 1477630 | 3/1966 | France | 4/368 |

*Primary Examiner*—William A. Cuchlinski, Jr.
*Assistant Examiner*—John L. Beres
*Attorney, Agent, or Firm*—William H. Maxwell

[57] ABSTRACT

A toilet flushing apparatus characterized by an inherently leakproof syphon, a manually discharged primer tank initiating syphoning through a discharge tube and toilet flush tube, and with a floating flush valve and control for complete discharge of primer water followed by immediate closure to ensure continued syphoning, the primer tank being automatically refilled with the rise of float controlled supply tank water.

15 Claims, 4 Drawing Sheets

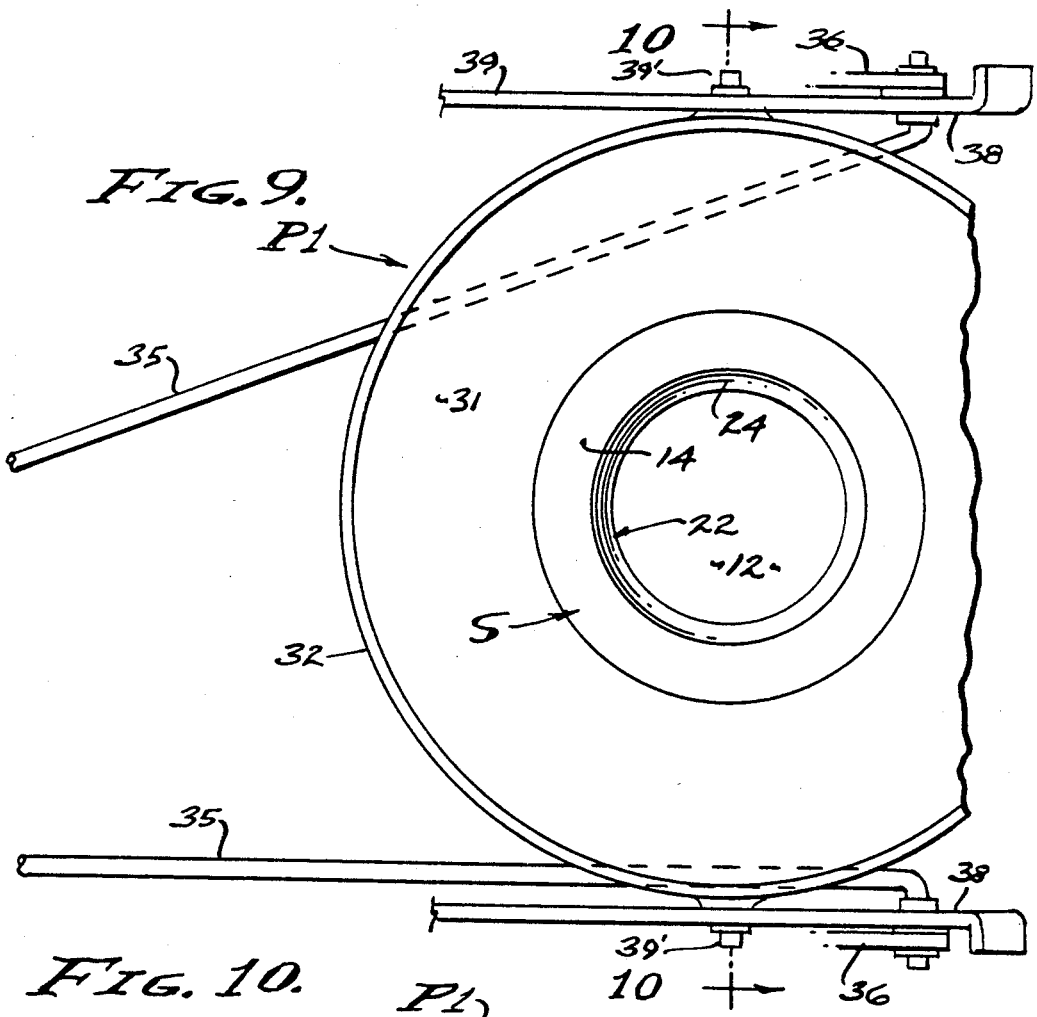
FIG. 9.
FIG. 10.
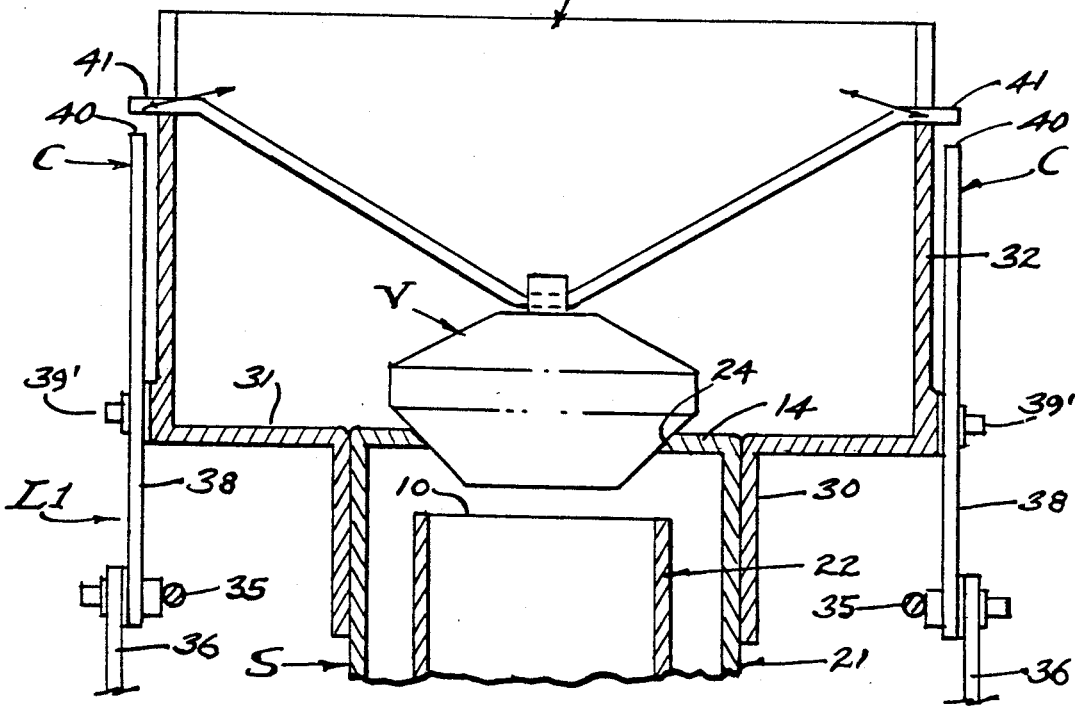

PRIMER TANK TOILET FLUSHING APPARATUS

BACKGROUND OF THE INVENTION

A common flushing apparatus for toilets invloves a reseating flush valve that holds a large volume of supply water in a tank from which it is suddenly released into the toilet bowl. And, a float valve is responsive to the water level in the tank to replace the water level, operating automatically and separately from the flush valve that is manually operated by movement of a flush handle or lever that is turned to lift the flush valve. A detrimental feature of this common system is that the flush valve tends to and eventually leaks, resulting in continued water waste.

Another flushing apparatus, common in the United Kingdom, involves a syphon tube having its suction leg depending into the supply tank so as to be filled with water, and its discharge leg normally empty of water and opening into the toilet bowl, and operated by means of a primer pump that is manually actuated to fill the discharge leg thereby initiating syphoning. The said primer pump operates as a water lifting means in the suction leg of the syphon, and the advantage of this syphon system is that there can be no leakage from the supply tank through the inactive syphon. However, the pump means gradually deteriorates and requires repeated cycles of operation in order to complete a flushing of the toilet, and eventually becomes inoperative.

In view of the foregoing, it is an object of this invention to employ the aforesaid syphon tube flush principle of operation to the exclusion of a pump means, and replacing the aforesaid pump-type primer means with a tank-type primer means and flush valve, all in combination with an otherwise conventional toilet.

The syphon principle of operation is superior with respect to the conservation of water, in that there can be no continuous leakage therethrough when its discharge leg is empty of water. And, only when the discharge leg is primed does water flow therethrough. On the contrary, the conventional flush valve principle of operation is prone to continuous leakage from the water supply tank and through the flush tube, due to deterioration of either the valve seat or valve ball. It becomes apparent therefore that the syphon principle is superior, except for the inevitable deterioration of the pump means therefor which typically deteriorates and requires repeated cycles of operation in order to complete a flushing of the toilet, and inevitably becomes inoperative.

In view of the foregoing, it is an object of this invention to employ the aforesaid syphon tube flush principle of operation to the exclusion of a pump means, and replacing the aforesaid pump-type primer means with a tank-type primer means and flush valve, all in combination with an otherwise conventional toilet.

The syphon principle of operation is superior with respect to the conservation of water, in that there can be no continuous leakage therethrough when its discharge leg is empty of water. And, only when the discharge leg is primed does water flow therethrough and through the flush tube. On the contrary, the conventional flush valve principle of operation is prone to continuous leakage from the water supply tank and through the flush tube, due to deterioration of either the valve seat or valve ball. It becomes apparent therefore that the syphon principle is superior, except for the inevitable deterioration of the pump means thereof which is typically a flap or disc of flexible material that lifts the tank water into the syphon and initiates continued flow therethrough until the water supply tank is emptied through the flush tube. Accordingly, these two widely used principles of operation are each subject to deficiencies, one to inherent leakage and the other to eventual inoperation. In view of the foregoing, it is an object of this invention to provide a toilet flushing apparatus that virtually eliminates leakage of the flush water, and that provides automatic refilling of the primer tank for repeated flushings.

It is to be understood that the water supply tank is refilled after each flushing operation, or incomplete flushing operation, by means of a conventional and accepted water level responsive valve means from a water supply service pipe. in practice, a float controlled valve returns the tank water level to the bridge of the syphon after each flushing operation, complete or imcomplete. And, it is this maintained water level that automatically refills the primer tank.

The syphon principle of operation is characterized by two conditions, a passive condition wherein the discharge leg is dry, and a functioning condition wherein the discharge leg is wet. In order to achieve said wet condition, priming is required for filling the otherwise dry discharge leg with water, whereby syphoning action is initiated and continues to occur. It is an object of this invention to prime the syphon tube by discharging a relatively small volume of water through the flush tube so as to initiate the syphon effect. In practice, flooding of the syphon discharge leg enables the syphon to function with a downward velocity of water suddenly dumped therethrough. Accordingly, the apparatus herein disclosed is characterized by a manually actuated primer means, preferably a vertical discharge primer tank, that dumps into and floods the flush tube.

The sudden discharge of primer tank water into the flush tube is a prerequisite to successful flushing, and to this end it is an object of this invention to provide flush valve control means by which primer tank water is withheld from discharge until the primer tank is sufficiently raised to establish the requisite head of water necessary to initiate the syphon effect and ensure its continued function.

The sudden termination of primer tank water discharge and closure of the syphon to atmosphere is also a prerequisite to successful flushing, and to this end it an object of this invention to provide flush valve control means by which the flush valve closes as and when the primer tank water is depleated, thereby shutting off the outside atmosphere for continued syphoning, The flush valve is a conventional floating ball type valve. In practice, the aforesaid means by which primer tank water is witheld involves lift means by which the primer tank is raised, and shut off means by which the flush valve is closed. As will be described, the primer tank is raised by a lever operated toggle with a sear that lifts and drops the flush valve onto a seat that opens into the syphon discharge leg to initiate continued syphoning.

In a second basic form (FIGS. 11 to 14) the primer tank is fixed and flushing control relegated to the flush valve. Whereas the primer tank is immersed in the first described form, it is simply raised in the second form, and reliant upon timed supply of float valve filling of the supply tank. However, in the event of a flush valve leak or malfunction, the primer tank water can be lost in this second embodiment. But, only a small quantity of water can be wasted. A feature of both embodiments is the floating flush valve that inherently reseats.

SUMMARY OF THE INVENTION

This invention relates to water closets or toilets and particularly to the flushing apparatus therefor by which defication and urination etc. is disposed of as sewage. Heretofore, substantial quantities of water have been wasted by flushing apparatus employed, as by inherent leakage and by mechanical deterioration resulting in malfunctions and/or insufficient operation requiring repeated flushing attempts. The flush valve type of apparatus that is manually activated to open the conventional flush tube is subject to continuous leakage and waste of water, while the non-leak syphon type apparatus inevitably deteriorates mechanically and eventually becomes inoperative. However, it is an object of and this invention combines the advantage of the non-leak syphon type apparatus with a primer means, whereby the pump means is eliminated and the controlling flush valve is not subject to any leakage.

The toilet flushing apparatus herein disclosed is primer tank activated, simply by flooding the flush pipe with water at velocity through a syphon discharge tube in order to initiate syphoning that depletes the water supply tank during each flushing operation. Accordingly, this invention is characterized by a syphon discharge and flush tube, and by a rechargeable primer tank that is raised so as to establish a sufficient head of primer water that is released by a floating flush valve to flood the discharge tube and initiate syphoning followed by immediate closure to oensure continued syphoning. In practice, syphon tube flow capcity is such as to require but a small quantity of water, a pint or two, discharged from a short height above the bridge of the syphon. The discharge tube is also relatively small. And, it is to be understood that operation of the flushing apparatus is dependent upon refilling of the water supply tank by a water level control, such as a float controlled water level valve or the like, so that the tank water returns to the bridge level of the syphon and also refills the primer tank after each flushing operation.

The foregoing and various other objects and features of this invention will be apparent and fully understood from the following detailed description of the typical preferred forms and applications thereof, throughout which reference is made to the accompanying drawings.

THE DRAWINGS

Figure 5:
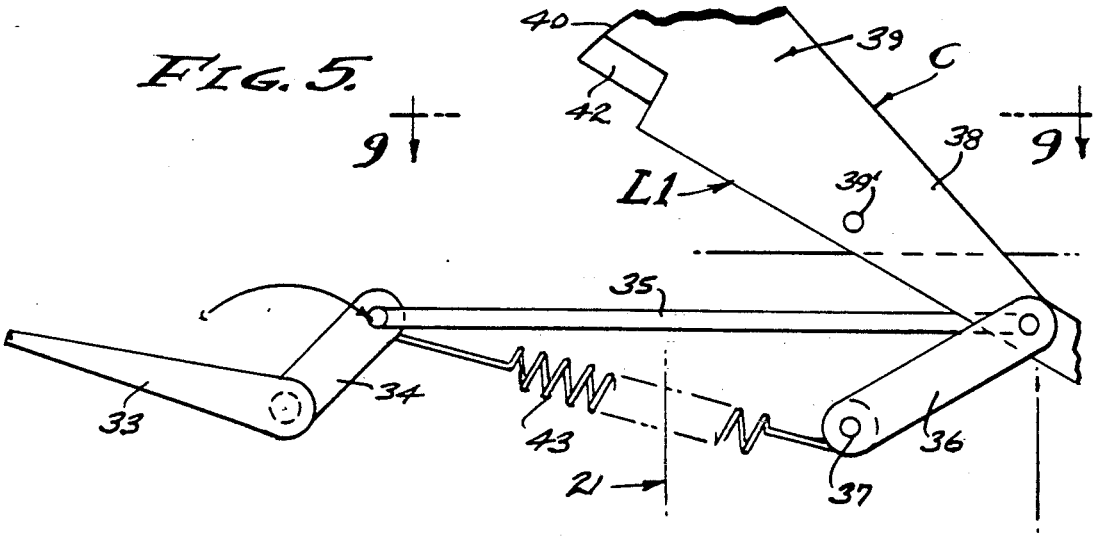
FIG. 5 is an enlarged fragmentary view of the manually operable flushing mechanism, taken as indicated by line 5—5 on FIG. 1. And, FIGS. 6 and 7 are views similar to FIG. 5, FIG. 6 showing a partially activated condition, and FIG. 7 showing a completely activated condition.

FIGS. 9 and 10 are enlarged detailed views, FIG. 9 being taken as indicated by line 9—9 on FIG. 5, and FIG. 10 taken substantially as indicated by line 10—10 on FIG. 9.

Figure 11:
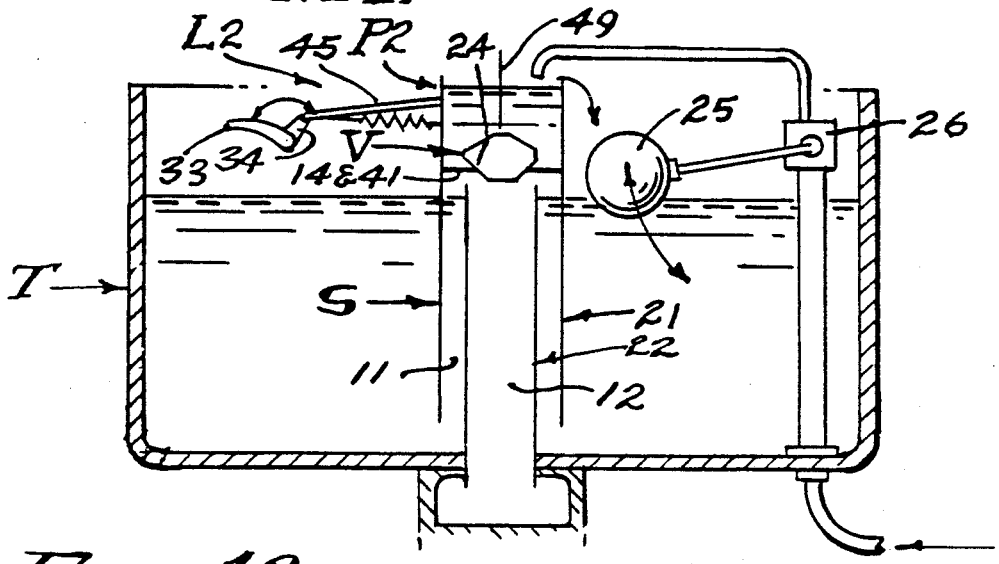
Figure 12:
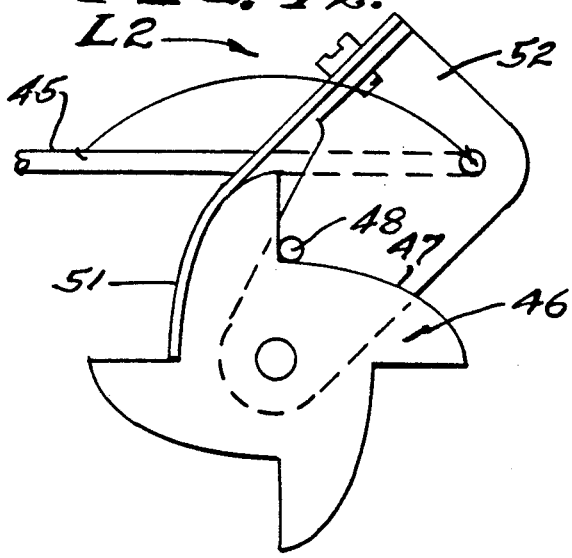
Figure 13:
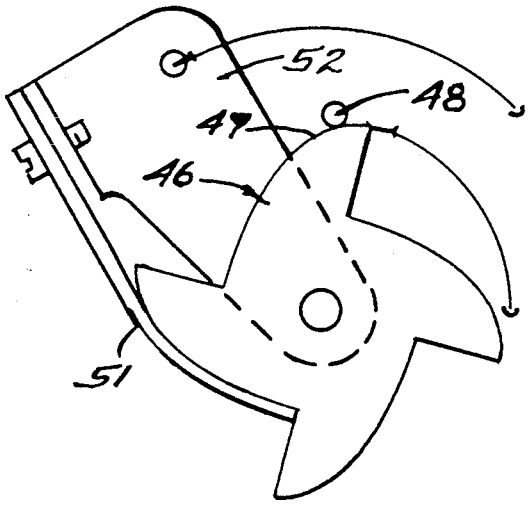

FIGS. 11–14 illustrate a second embodiment, FIG. 11 showing installation, and FIGS. 12–13 showing control means for the float valve, passive, partially actuated and fully actuated.

PREFERRED EMBODIMENT

Referring now to the drawings, the toilet and water supply tank T are conventional in every respect. And, the tank water level is controlled by a conventional float valve, so that the water supply level reaches a predetermined position just below a weir or bridge 10 of a syphon S within the tank. In accordance with this invention, there is the syphon S comprised of a suction leg 11 and a discharge leg 12, preferably concentric tubes 21 and 22 wherein the suction leg 11 is an annulus that surrounds the discharge leg 12 opening into a flush tube 23. The suction leg 11 in an annular area that opens from the bottom of the tank T and over the bridge 10 and into the top of the circular area of the discharge leg 12 via a closed header 14, the suction leg 11 being filled with tank water to the bridge 10 level, and the discharge leg 12 drained empty after each flushing. The header 14 closed the top of the annulus between tube 21 and tube 22, forming a transfer passage joining the two legs. A feature is the valve seat 24 opening through the header and into the discharge leg 12, this valve seat opening being substantially the same in diameter as the inside diameter of the tube 22. Another feature is the annulus opening of the transfer passage beneath the valve seat 24 and into the discharge leg 12 or tube 22, said passage and leg 12 or tube 22 being empty in the passive condition when the water level rises to a maximum at the bridge 10 of the syphon. The discharge leg 12 and said upper transfer passage remain emty of water after each flushing, while the suction leg 11 refills.

The toilet fixture is conventional, having a water supply tank T that is automatically filled with water by means of a float 25 controlled valve 26 from a water supply pipe 27. The water level in tank T is limited to a predetermined point just below the bridge 10 of the syphon S. The syphon discharges through flush tube 23 and into the toilet bowl B for flushing in the usual manner, as is clearly shown in the drawings.

In accordance with this invention there is a raised primer tank, the discharge tube 22 being flooded thereby with water that rushes by gravity to draw water through the transfer passage and over the bridge 10 of the syphon. The rush of water has a jet pump action that reduces pressure in the discharge leg 12 with suction sufficient to initiate the syphoning effect causing the tank T water to rise in the suction leg 11 and to flow through the transfer passage and over the bridge 10 and down the discharge leg 12. The close proximity of the leg walls of tubes 21 and 22 and of the header 14 to the bridge 10 are such as to establish a solid liquid flow of water that ensures the initiation of syphoning which then inherently continues when the flush valve V is closed, as will be described. The discharge area of the transfer passage into the discharge tube 22 is substantially the same as the cross section areas of syphon legs 11 and 12 and of the flush tube 23 into the toilet bowl. Accordingly, there is a continuous rush of flush water from the syphon S and into the toilet bowl.

The primer tank P1 in the first embodiment (FIGS. 1–10) is an inherently leak-proof device that is shiftable so as to be submerged in the passive condition and automatically filled with supply tank water, and adapted to be raised so as to dump the same into the discharge tube 22 by opening the flush valve V. Height of the apparatus is of concern, and to this end it is a feature of primer tank P1 that it is submerged and need only be raised and then discharged and immediately closed when emptied, all as next described.

Figure 1:
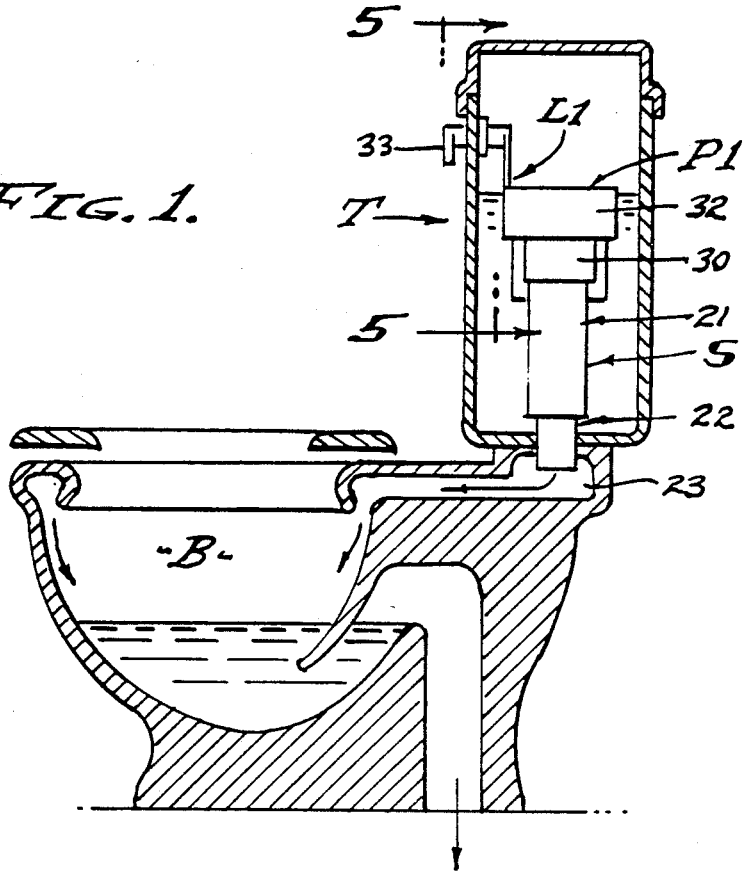
FIG. 1 is a cross sectional view of a toilet with the flushing apparatus of a first embodiment of the present invention installed therein.
Figure 2:
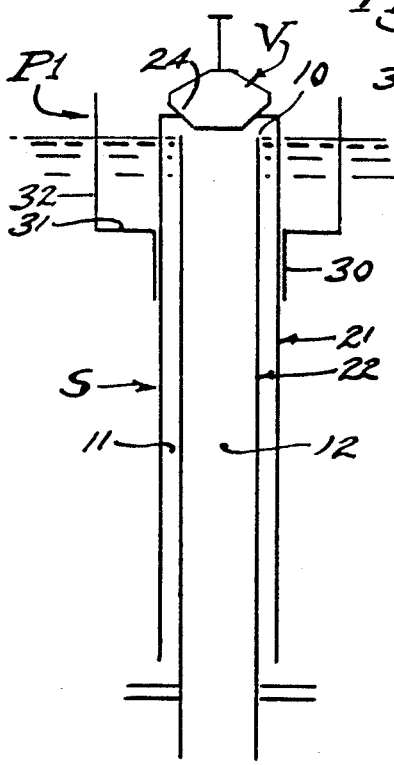
FIGS. 2, 3 and 4 are enlarged sectional views of the syphoning apparatus, FIG. 2 showing the passive condition ready for flushing, FIG. 3 showing the activated condition and initiation of the syphon effect, and FIG. 4 showing the continued syphoning effect.
Figure 3:
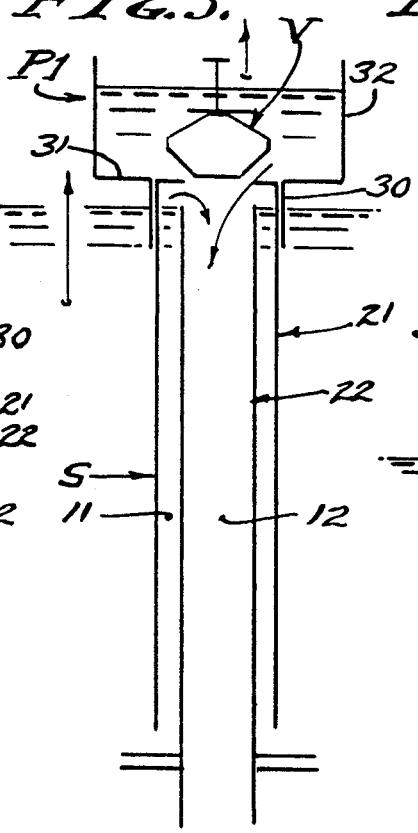
Figure 4:
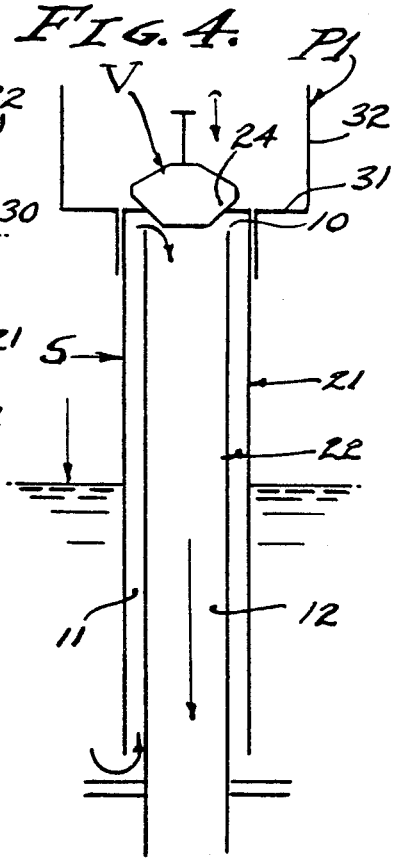

The primer tank P1 is slidably carried over the upper portion of the outer tube 21 of the syphon S, by a skirt 30 closely fitted thereover, and with a bottom 31 that encircles said tube. Radial extent of the bottom 31 in conjunction with the extent of an upstanding peripheral wall 32 determines the volume capacity of the primary tank, a pint or two being sufficient. The primary tank P1 has two operating positions, a down position when passively filled and ready for use wherein the bottom 31 is lowered and the top edge of wall 32 substantially coincidental with the plane of header 14, and an up position when raised and wherein the bottom 31 is coincidental with the plane of header 14. A feature is that the valve seat 24 is also coincidental with the plane of the header 14 and with the bottom 31 when it is raised, so that all of the tank water can be discharged. Note that the flush valve V is opened as and when the primary tank P1 is substantially or fully raised as shown in FIGS. 3 and 6.

In accordance with this invention, means is provided to open the bottom 31 of the primary tank P1 in its raised condition to dump into the discharge leg 12 of the syphon S. In this first embodiment now under consideration, the water discharge function is performed by the combination of lifting means L1 that raises the primer tank P1 and opens the flush valve V. As shown, there is a manually operable handle 33 that turns a bellcrank 34 (90°). A pull rod 35 extends to a toggle comprised of a lower link 36 rotatable on a horizontal axis or trunnion 37 positioned below the upper portion of tube 22 over which the skirt 30 slides, and an upper link 38 rotatable on a horizontal axis or trunnior 39 projecting from and carrying the bottom of the primer tank. In practice there are diametrically opposite sets of toggles that support and raise the primer tank P1, operated by a pair of divergent pull rods 35 extending from the bellcrank 34 (see FIG. 9). In the passive lowered condition, the links 36 and 38 are accutely related as shown in FIG. 5. In the active raised condition, the links 36 and 38 are obtusely related as shown in FIGS. 6 and 7. In the full up position as shown in FIG. 7 (180°) the links 36 and 38 are locked so as to ensure a fully raised position of the primer tank P1.

Figure 6:
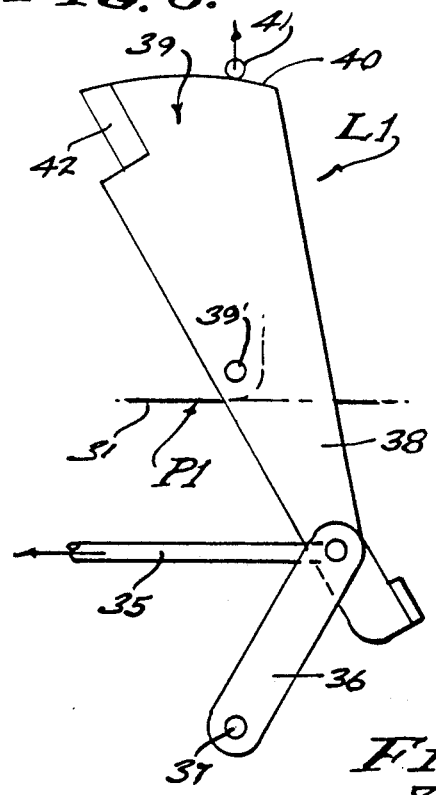
Figure 7:
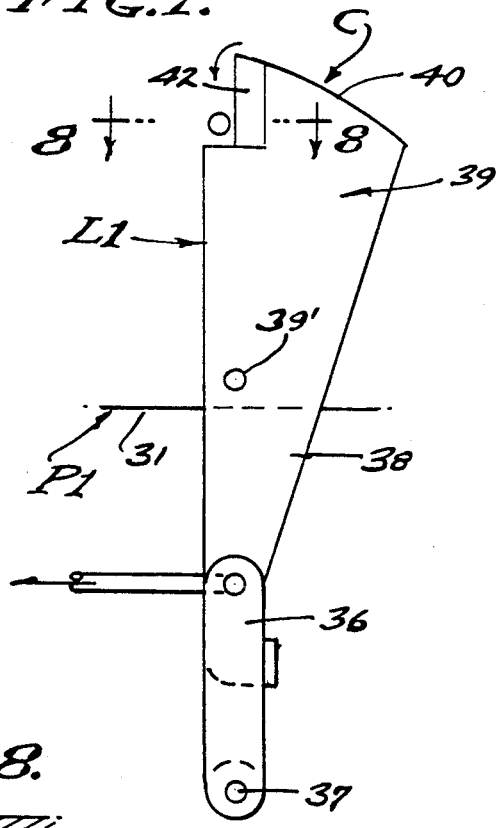
Figure 8:
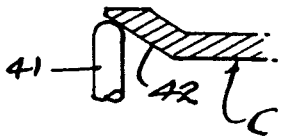
FIG. 8 is an enlarged fragentary sectional view taken as indicated by line 8—8 on FIG. 7.

The bottom 31 of primer tank P1 is opened by the flush valve V lifted from the seat 24, this function being provided by cam means C as best illustrated in FIGS. 5–8. In practice, there is a cam 39 in the form of a First Class Lever arm of link 38, said cam having a peripherally inclined face 40 engageable with a lift bars 41 extending upward from the flush valve V. As the cam 39 rises with primer tank P1, it lifts the bar 41 when engaged thereby as shown in FIG. 6, and additionally as the toggle straightens to the FIG. 7 condition the inclined cam face 40 augments the valve lift action.

A necessary feature of this invention is the immediate release of the bar 41 and flush valve V after it is unseated, so that it is permitted to float upon and downward with the primer tank water and reseat when the primer tank water is depleated. Accordingly, the flush valve V is a float valve, essentially a hollow ball or the like. The aforesaid release function is shown in FIG. 7, wherein the bar 41 has dropped over the cam 39. Another feature is the return of the toggle and primer tank P1 to the initial passive condition, accomplished by inward depression of the bar 41 by means of a cam 42 that permits collapse of the toggle (see FIG. 8). A return spring 43 pulls the toggle to the collapsed lowered condition of FIG. 5.

The primer tank P2 of the second embodiment (FIGS. 11–14) differs from the first embodiment by being fixedly raised for flushing and automatic filling with supply tank water supplied by the float level control valve 26. The flush valve V retains the primer tank water only, ready to be dumped into the discharge tube 22, and it is a feature of this primer tank P2 that it is raised and need only to be discharged and immediately closed to the syphon S, all as next described.

The primer tank P2 is fixedly carried by and is shown as an upward extension of the outer tube 21 of the syphon S, and with a bottom 41 integral with the header 14. Vertical extent of the primer tank wall determines the volume capacity of the primer tank, a pint or two being sufficient. The primer tank P2 is automatically filled with water by means of the float 25 controlled valve 26, through a filler pipe as shown, and it overflows when filled so as to spill into tank T and lifting the float 25 to a limit (see FIG. 11). A feature is that the valve seat 24 is coincidental with the plane of the header 14 and with the bottom 41, so that all of the tank water can be discharged, all as hereinabove described re the first embodiment.

Figure 14:
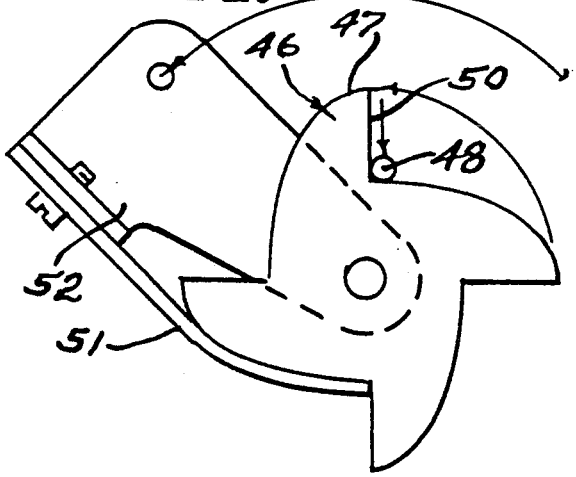

In accordance with this invention, means is provided to open the bottom 41 of the primer tank P2 to dump its water into the discharge leg 12 of the syphon S. In this second embodiment now under consideraton, the water discharge function is performed by the combination of lifting means L2 that raises and opens the flush valve V. As shown, there is the manually operable handle 33 that turns the bellcrank 34 (90°). A pull rod 45 extends to a lift means in the form of a cam 46 rotatable on a horizontal axis or trunnion positioned at the top side of the primer tank. The cam 46 has three conditions as follows: (1) A passive condition as shown in FIG. 12 wherein a lift bar 48 rests upon a radially depressed portion of the cam face 47, so that the flush valve V attached to said lift bar by a stem 49 remains seated as shown in FIG. 11. (2) An actuated condition as shown in FIG. 13 wherein the lift bar 48 is lifted upon a radially displaced portion of the cam face 47, so that the flush valve V is unseated to float upon the primer tank water, with the seat 24 fully open into the discharge tube 22 and leg 12. And, (3) A syphoning condition as shown in FIG. 14 wherein the lift bar 48 is released over a step 50 so that the flush valve V is free to float downward and reseat when the primer tank water is depleated.

In practice, the lifting means L2 is a rotary ratchet comprised of a toothed wheel having a multiplicity of cams 47, each as above described, and advanced one at a time by a spring pawl 51 operated by a lever 52 oscillated by the pull rod 45, as shown. The bottom 41 of the primer tank P2 is opened by the flush valve V lifted from the seat 24, this function being provided by the cam 46 as best illustrated in FIGS. 12–14. In practice, there is a return spring (as shown) that pulls the lever 52 to the passive condition of FIG. 12.

From the foregoing it will be understood how the syphon function is initiated by dumping a charge of water from the raised primer tank and over the transfer opening defined by the bridge spaced immediately below the header that seats the flush valve. The manually unseated flush valve opens the seat which dumps primer tank water over the transfer opening to initiate the syphoning effect. And, the flush valve floats downward on the primer tank water and reseats when the primer tank water is depeated and thereby closes the syphon to surrounding atmosphere so as to ensure continued syphoning effect.

Having described only the typical and preferred forms and applications of my invention, I do not wish to be limited or restricted to the specific details herein set forth, but wish to reserve to myself any modifications or variations that may appear to those skilled in the art, as set forth within the limits of the following claims.

I claim:

1. A flushing apparatus for toilets having a flush tank and a flush tube opening therefrom and into a toilet bowl, and having a water level control means responsive to depletion of water in said tank to refill said tank to a predetermined water level, said apparatus including;

a syphon within the flush tank and comprised of a suction leg opening within the bottom of said tank and extending upward to a bridge at the aforesaid predetermined water level, and a discharge leg continuing from the suction leg and extending downward from the bridge and discharging into the aforesaid flush tube of the toilet, a header extending horizontally from the suction leg and spaced above the bridge to define a transfer opening into the discharge leg and having a seat opening therethrough and into the discharge leg, a flush valve passively closing the seat opening, a raised primer tank for dumping a charge of water through the seat opening and over the transfer opening for inducing a suction effect from the suction leg and into the discharge leg, whereby water from the suction leg is drawn over the bridge and syphoning initiated to flush the toilet, and means opening the passively closed flush valve and then closing the same when the primer tank water is depleted, thereby isolating both the suction and discharge legs from external atmosphere for continued syphoning effect until the flush tank water level is depleted.

2. The flushing apparatus for toilets a set forth in claim 1, wherein the suction leg and discharge leg of the syphon are formed by concentric tubes.

3. The flushing apparatus for toilets as set forth in claim 1, wherein the primer tank is fixedly carried above the header and seat opening therein.

4. The flushing apparatus for toilets as set forth in claim 2, wherein the suction leg is an annulus and the discharge leg is circular and both of substantially the same cross sectional area.

5. The flushing apparatus for toilets as set forth in claim 1, wherein the suction leg and discharge leg of the syphon are of substantially the same cross sectional area as that of the flush tube.

6. The flushing apparatus for toilets as set forth in claim 1, wherein the suction leg has a bottom terminal end spaced above a bottom of the flush tank, the discharge leg opening through the bottom of the flush tank and into the flush tube.

7. The flushing apparatus for toilets as set forth in claim 1, wherein the flush valve is floatable, said means opening the passively closed flush valve unseating the same to float upon the primer tank water and to be reseated when primer tank water is depleted through said seat opening through the header.

8. The flushing apparatus for toilets as set forth in claim 7, wherein the means opening and closing the flush valve is a manually operable lift means with a step over which a lift bar on the flush valve is raised and then released to float the flush valve.

9. The flushing apparatus for toilets as set forth in claim 7, wherein the means opening and closing the flush valve is a manually rotatable cam means with a lift face and a step over which a lift bar on the flush valve is raised and then released to float the flush valve.

10. The flushing apparatus for toilets as set forth in claim 1, wherein the primer tank is slidable carried over the syphon between a submerged position in the flush tank and to a raised discharge position over the header and seat opening therethrough.

11. The flushing apparatus for toilets as set forth in claim 1, wherein the primer tank is slidably carried over the suction leg of the syphon and movable between a submerged position in the flush tank and to a raised discharge position over the header and seat opening therethrough.

12. The flushing apparatus for toilets as set forth in claim 1, wherein the primer tank is slidably carried by manually operable lever means to move between a submerged position in the flush tank and to a raised discharge position over the header and seat opening therethrough.

13. The flushing apparatus for toilets as set forth in claim 1, wherein the primer tank is slidably carried by manually operable lever means to move between a submerged position in the flush tank and to a raised discharge position over the header and seat opening therethrough, and with cam means to release the flush valve when the primer tank is raised.

14. The flushing apparatus for toilets as set forth in claim 1, wherein the suction leg has a bottom terminal end spaced above a bottom of the flush tank, the discharge leg opening through the bottom of the flush tank and into the flush tube, and wherein the primer tank is slidably carried by manually operable lever means to move between a submerged position in the flush tank and to a raised discharge position over the header and seat opening therethrough.

15. The flushing apparatus for toilets as set forth in claim 1, wherein the flush valve is floatable, said means opening the passively closed valve unseating the same to float upon the primer tank water and to be reseated when primer tank water is depleted through said seat opening through the header, and wherein the primer tank is slidably carrieds by manually operable lever means to move between a submerged position in the flush tank and to a raised discharge position over the header and seat opening therethrough and with cam means to release the flush valve when the primer tank is raised.

* * * * *